US005634300A

United States Patent [19]

Huebner et al.

[11] Patent Number: 5,634,300

[45] Date of Patent: Jun. 3, 1997

[54] WALL SYSTEM EMPLOYING GROOVED POSTS, CONNECTOR BLOCKS AND T-BOLT RECEIVING BATTENS

[75] Inventors: Fritz Huebner, Holland; Amy V. Schouman, Wyoming, both of Mich.

[73] Assignee: Plascore Inc., Zeeland, Mich.

[21] Appl. No.: 209,119

[22] Filed: Mar. 10, 1994

[51] Int. Cl.[6] ..... E04B 1/19

[52] U.S. Cl. ..... 52/36.1; 52/36.6; 52/281; 52/282.1; 52/731.5; 52/7.319; 52/770; 52/771; 52/772; 52/775

[58] Field of Search ..... 52/775, 772, 282.2, 52/282.1, 731.9, 731.5, 281, 770, 771, 204.62, 204.67, 204.68, 204.7, 36.1, 36.2, 36.4, 36.5, 36.6

[56] References Cited

U.S. PATENT DOCUMENTS

| | | | |
|---|---|---|---|
| 3,057,444 | 10/1962 | Walberg | 52/775 X |
| 3,513,606 | 5/1970 | Jones | 52/282.2 X |
| 3,566,561 | 3/1971 | Tozer | 52/282.1 X |
| 4,270,332 | 6/1981 | Montrouil | 52/772 |
| 4,625,483 | 12/1986 | Zacky et al. | 52/282.2 X |
| 4,984,400 | 1/1991 | Bockmiller | 52/775 X |
| 5,307,600 | 5/1994 | Simon, Jr. et al. | 52/264 X |
| 5,414,967 | 5/1995 | Cates et al. | 52/281 |

*Primary Examiner*—Christopher T. Kent
*Attorney, Agent, or Firm*—Price, Heneveld, Cooper, DeWitt and Litton

[57] ABSTRACT

A post and batten assembly for a wall panel system, the elongated post having a plurality of sides, at least one of which has an elongated groove and a pair of outer shoulders astraddle the groove, an elongated batten having a central body positioned in the elongated groove of and attached to the post, and the batten having a pair of flanges extending opposite each other and engaging the outer shoulders of the post, the batten central body having an outer face, and defining an elongated cavity open at the outer face, and the cavity having a pair of inner shoulders so that the cavity and inner shoulders define a T-slot in the batten to receive a T-bolt fastener. Fasteners connect the elongated batten to the post. Flanges of a pair of batten extend beyond the post parallel to each other to define a panel-receiving pocket therebetween. A connector block is attached to the post, and a second post is oriented orthogonally to the first post and has an end attached to the connector block so as to be indirectly connected to the first post in a T-pattern. The connector block is within one of the receiving pockets between a pair of said batten flanges. A panel has an edge within the panel-receiving pocket. If the panel in the pocket is a thin panel, it engages only one flange of the pocket, and a spacer clip engages the panel and the second flange of the pocket, or the spacer clip engages two thin panels.

24 Claims, 9 Drawing Sheets

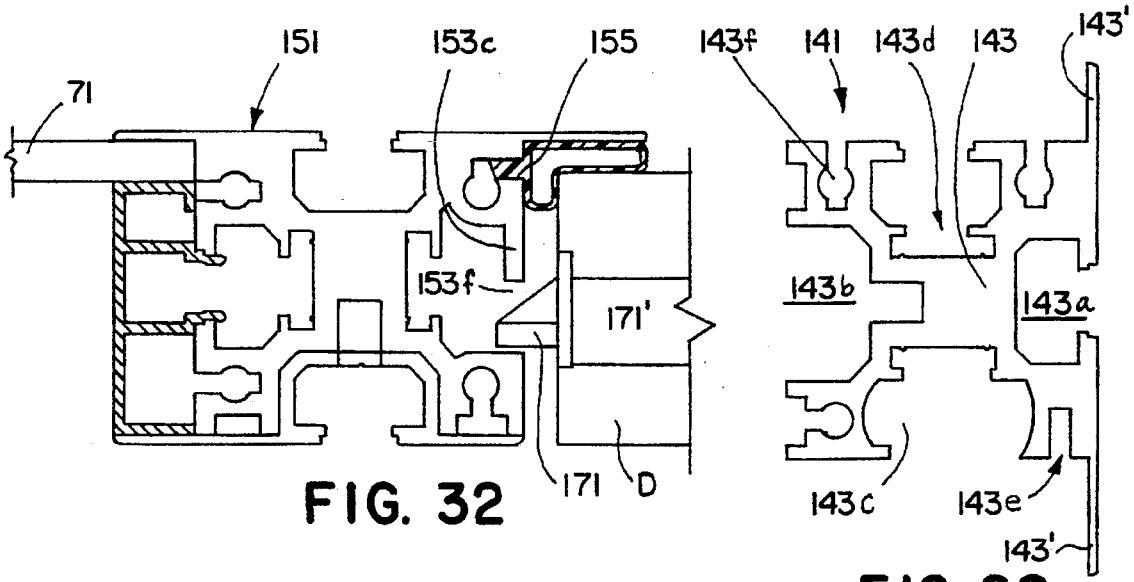
FIG. 32
FIG. 28
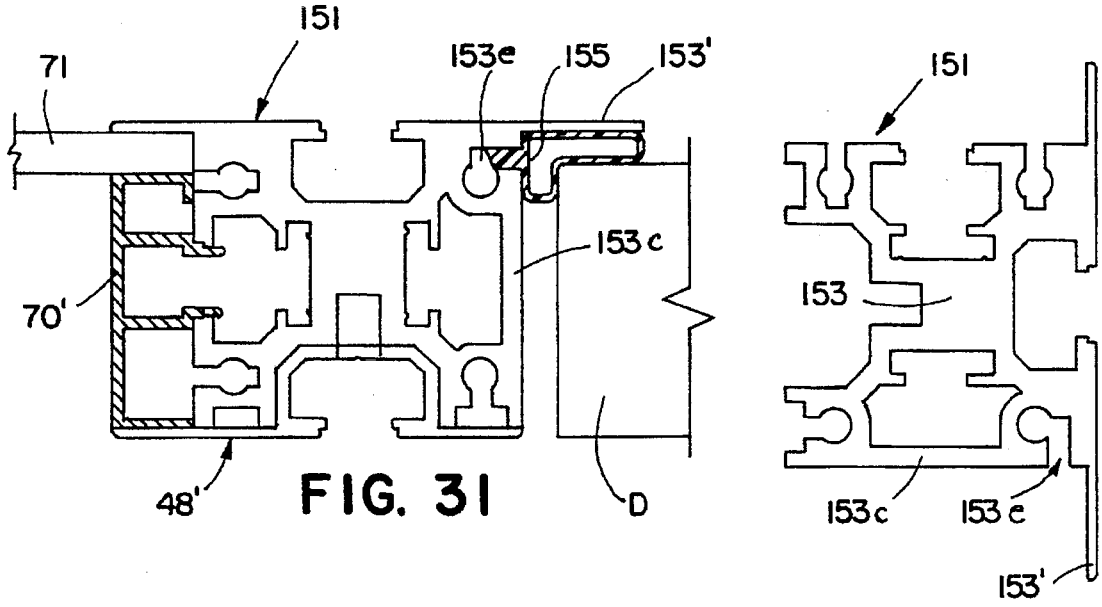
FIG. 31
FIG. 30

WALL SYSTEM EMPLOYING GROOVED POSTS, CONNECTOR BLOCKS AND T-BOLT RECEIVING BATTENS

BACKGROUND OF THE INVENTION

This invention relates to framed wall systems, and more particularly to post and panel type wall systems.

Construction of walls using metal posts and interfitting panels is well known. One popular type of post used has T-slots in its plurality of faces. Two of the opposite lateral T-slots can be used to mount wall panels. The front T-slot can be used to secure a batten which serves as a dress cover to cover the post and the adjacent junctures of the panels to the post. Alternatively, the front T-slot can be left exposed and used to mount a work surface, a computer module, a desk, shelving, or the like. When this alternative is used, the post and the junctures of the panels to the post remain exposed. Therefore, the exposed post should be painted or otherwise colored to blend with the panels. Even so, the unsightly junctures still remain exposed. One advantage of a post and panel wall system is the capability of changing the system to create a different arrangement or to simply change panel color. However, changing the nature and/or color of the panels of known systems requires changing the color of exposed posts also. Hence, the entire system must be dismantled, painted or anodized, and rebuilt.

Another disadvantage to known prior systems is that the post configuration must usually be different for different thickness and/or type panels to be mounted, e.g., one-quarter inch thick panels, two inch thick panels, single pane glass, dual pane glass, and the like. Moreover, when a door is to be incorporated into the wall, a door frame and door jamb must be specially built in to receive it. This is time consuming and costly, requiring skilled personnel.

The corner posts for the conventional wall systems are often of different size and configuration than the other posts, so that the adjacent panels must be specially modified at their edges to fit with it.

When forming the framing for post and panel walls, it is desirable to orient some posts horizontally and connect the ends thereof to the vertical posts. A common technique for doing this is to drill a hole in the vertical posts to receive threaded connectors with the horizontal posts. However, if the holes are not located with great accuracy by craftsmen, or if a post must have a portion cut off in the field during installation, the drilled connection can result in a very poor joint, or be useless for forming a joint. Another technique for joining the horizontal and vertical posts is with L-shaped brackets. However, these too often result in unsightly joints. Using these brackets causes the assembly to no longer be flush on both sides.

SUMMARY OF THE INVENTION

An object of this invention is to provide a novel post and panel wall system having several advantages and improved features over the known systems. The novel system has posts with battens that not only cover the post and the junctures of the post with adjacent panels, but also enable work components such as work surfaces, computer modules, desks, shelving, lighting or the like to be mounted after the battens are in place. The battens themselves are specially configured to have T-slots for mounting these work components. The posts have grooves for receiving a body portion of the battens, with the battens also having dress wings which cover the post and the junctures between the post and adjacent panels.

Panel changes can be easily and quickly made with the novel system. Moreover, if a different color or style panel is to be substituted, the battens can be easily removed as for repainting or substitution of different color battens, without requiring removal of the posts which form the framework structure, to thereby create an aesthetically matching system without having to paint or anodize the posts, or dismantle and later reassemble the entire structure.

Another feature of the novel system is the capability of attaching horizontal posts to vertical posts using conventional T-bolts and a novel connector block. The novel connector block is secured by fasteners to the end of the horizontal post, optionally at the manufacturing site if desired, for creating an exact and a tight joint with the vertical post, giving structural stability and strength. The fasteners thread into previously formed, elongated cavities in the extruded post. Wings of the novel battens cover these connector blocks from view, the connector blocks slidably fitting into the pockets formed between parallel flanges of the battens and/or wings in the post, followed by simple tightening of a couple of T-bolts and nut fasteners to fixedly join the structure. With use of the connector blocks, there is no need to cut notches in the battens or panels or posts as was previously done to make connections. With the connector blocks in place, the panels still fit in smoothly and the faces are flush with the sides of the post. The battens and posts are still of the same cut length, rather than the battens being cut back from the end of the post.

The novel wall system can receive thick, e.g., two inch wall panels, or thin, e.g., one-quarter inch wall panels, a single glazing pane, double glazing panes, or the like, without modifying the posts. A conventional door can be hung directly on one of the vertical posts using hinges that attach to the post with simple T-bolts, so that no added door frame or door jamb is necessary. Removal of and replacement of the door, or a window, or a panel of chosen thickness and substitution by another component or other components is quick and easy. Moreover, the components need not be cut or drilled in the field during assembly. The assembly can be readily and rapidly fit together without special skill or special tools being required. The novel system is also capable of having panels in a T formation about the post, without requiring a special panel for the third position, or a special post.

These and several other objects, advantages and features of the invention will be understood by those in the art from a review of the following specification in conjunction with the drawings.

BRIEF DESCRIPTION OF THE DRAWINGS

FIG. 28 is an end elevational view of a top door jamb;

FIG. 30 is an end elevational view of a side floor jamb;

FIG. 31 is a sectional view of the side door jamb in FIG. 30, with portions of a conventional door;

FIG. 32 is a sectional view of the side door jamb in FIG. 30, with portions of a conventional door and door latch.

DESCRIPTION OF THE PREFERRED EMBODIMENTS

As will be understood from the following detailed specification in conjunction with the drawings, the novel wall system can take any of a variety of forms incorporating vertical and horizontal posts, panels which can be thick panels, thin panels, glazing panels, or double glazing panels, and can incorporate one or more windows, one or more doors, can be in a T configuration with three panels from a post, can extend in one dimension or in two dimensions from a corner post, or in three dimensions in a T arrangement, and other combinations of arrangements, as will be apparent to those skilled in this art.

Figure 1:
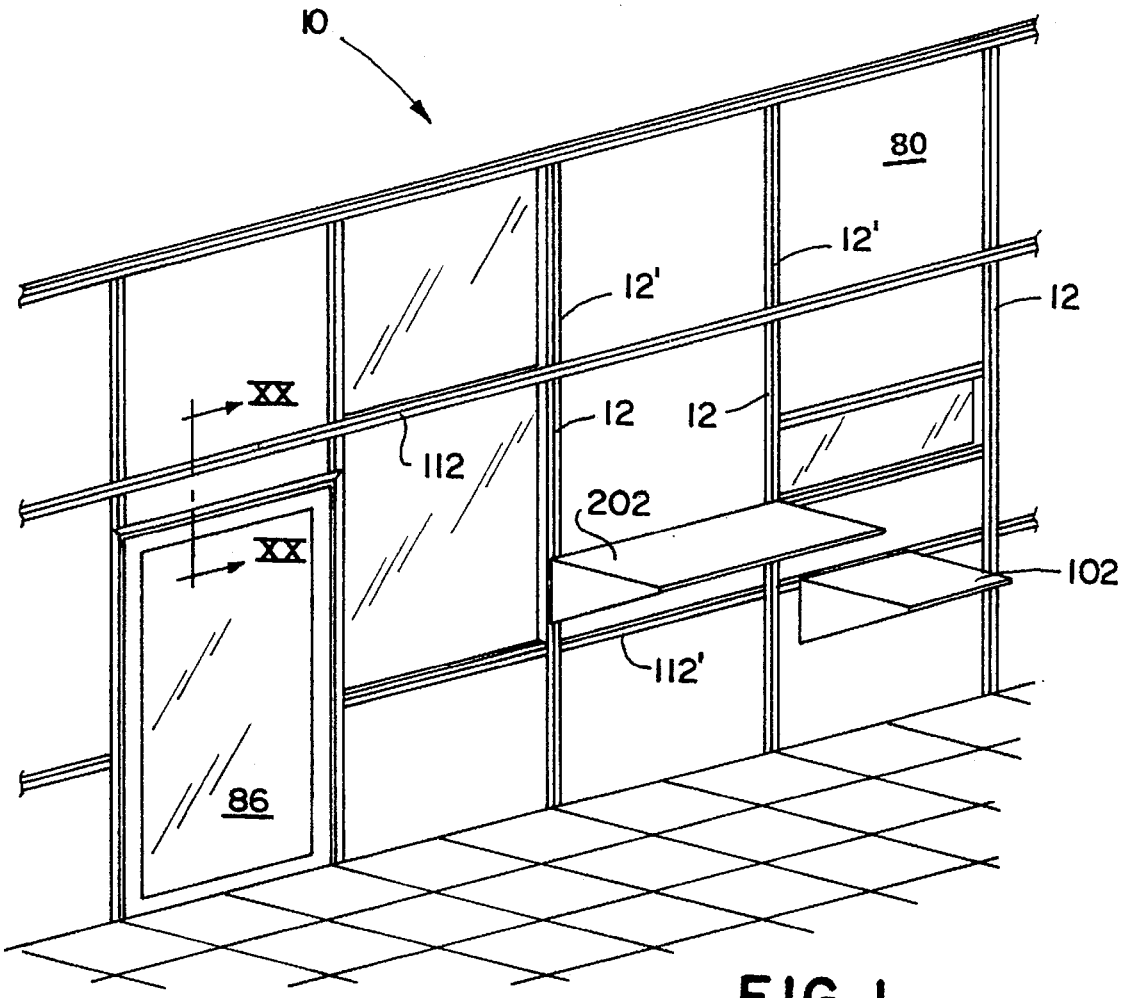
FIG. 1 is illustrative of a wall system made in accordance with this invention, showing representative components thereof and shelf items attached thereto on a floor.
Figure 3:
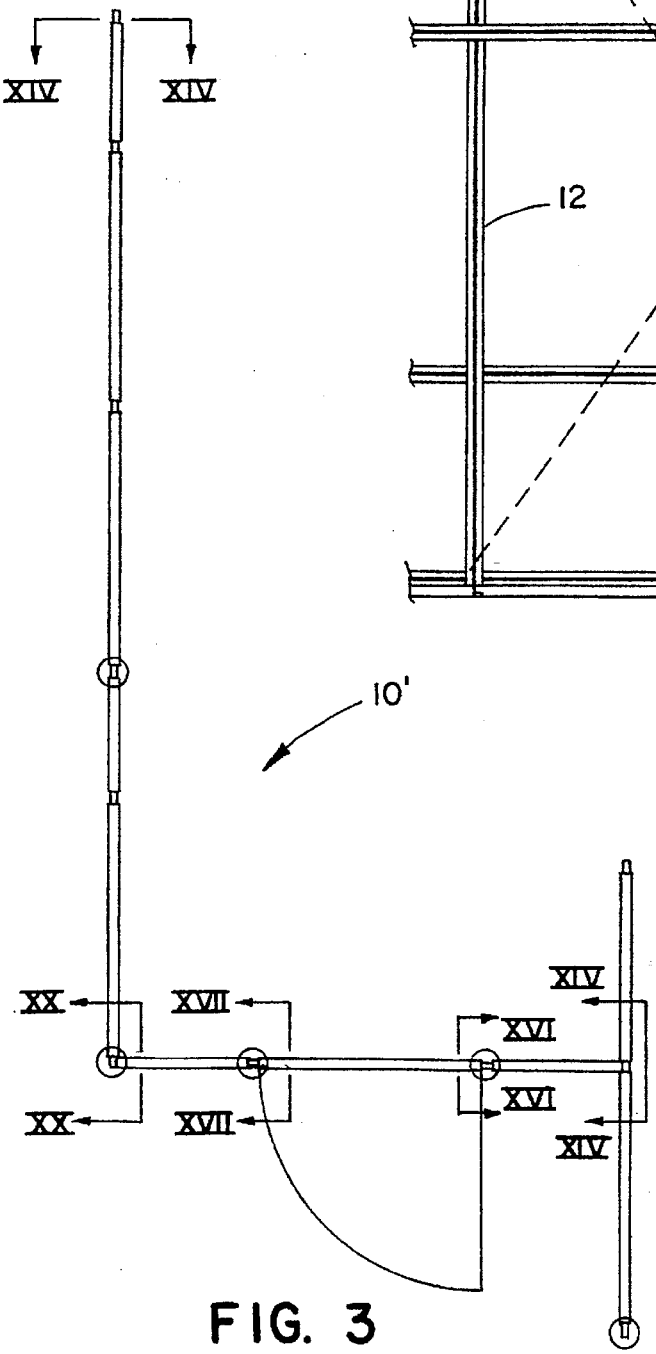
FIG. 3 is a plan view of another representative wall system of this invention.

Referring specifically to the drawings and the illustrative arrangements there set forth, the post and panel wall system 10 in FIG. 1 (or 10' in FIG. 3) is shown to include a plurality of posts, some of which are vertical and some of which are horizontal. The vertical posts are shown to be of differing lengths in the illustrative arrangement, with taller, lower vertical posts 12 and shorter, upper vertical posts 12'. These vertical posts connect with longer, horizontal posts 112 and shorter, horizontal posts 112', all interconnected in a desired pattern with the posts being at a selected spacing to each other for receiving and mounting panels thereto. Each of the vertical and horizontal posts is of an extruded construction, preferably of aluminum, cut to selected lengths. The posts are preferably primarily of the cross sectional configuration illustrated in FIG. 4, with a selected number of them optionally being configurated as in FIG. 5 or FIG. 6, or FIGS. 27, 28 or 30, as will be explained in more detail hereinafter.

Figure 13:
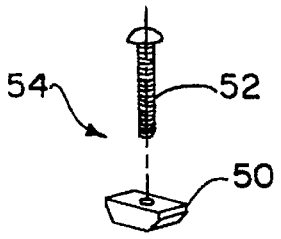
FIG. 13 is a perspective view of a T-bolt fastener formed of a T-nut and bolt.
Figure 2:
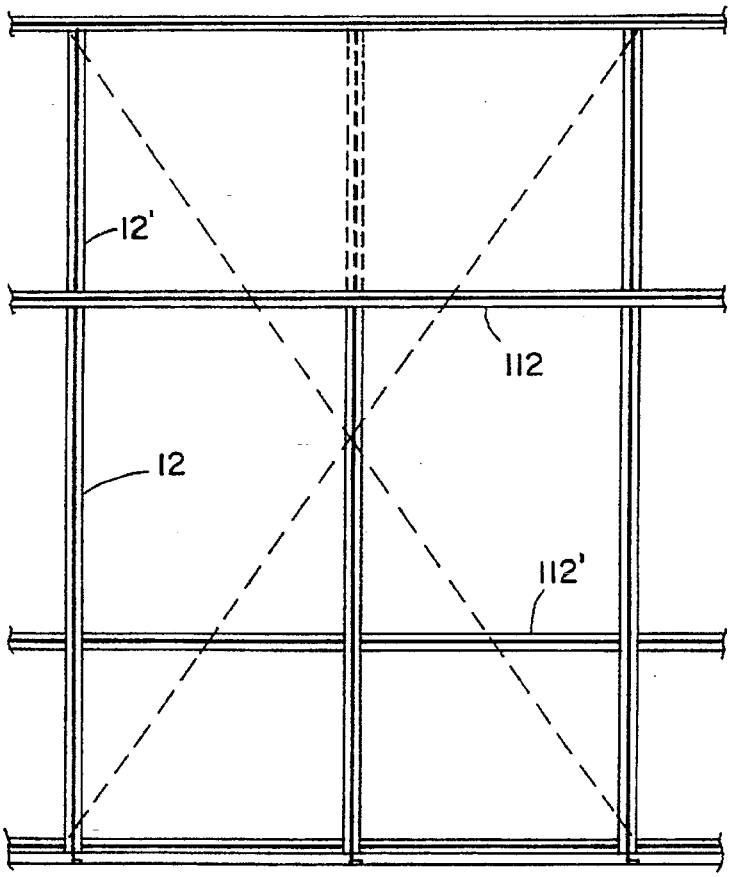
FIG. 2 is an elevational view of a portion of the wall system in FIG. 1, showing vertical and horizontal post arrangements between the ceiling and floor of a building.
Figure 4:
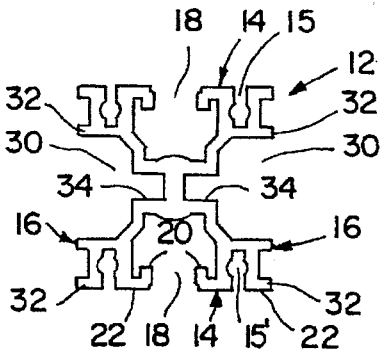
FIG. 4 is an end view of a post used for a vertical post or a horizontal post in the wall system.

Referring first to the post in FIG. 4, it is shown to have four sides, with two of these four sides being opposite lateral sides 14 and the other two being front and back sides 16. The two opposite lateral sides in this depiction each include elongated T-slots 18 having inner shoulders 20 and outer shoulders 22 astraddle slot 18. Inner shoulders 20 and slot 18 form a T-slot for receipt of a T-bolt fastener, specifically the T-nut 50 (FIG. 13) and T-bolt 52, nut 50 being insertable into and slidable along the inner space abutting inner shoulders 20, and bolt 52 extending through and outwardly of slot 18, with its bolt head outside the slot. Inner shoulders 20 can be of the cross sectional, generally U-shaped style in FIG. 4, or may be flat as shown at the top of the post in FIG. 28. Outer shoulders 22 can abut the edges of a panel such as a thick panel or a thin panel, e.g., a glazing panel, as will be explained more fully hereinafter.

Front and rear faces 16 of post 12 each include an elongated female groove 30 which is outwardly open and generally U-shaped in cross sectional configuration. Astraddle this groove is a pair of shoulders on outer abutments 32. As illustrated in FIG. 4, each of these abutments 32 preferably has an elongated slot 15 therein to prevent overly thick portions of metal being formed during the extrusion process, and having a portion 15' which is generally cylindrical, to receive threaded fasteners. This slot extends the length of the post. At the base of each U-shaped female groove 30 is shown an elongated channel 34, preferably having parallel ridges on both walls thereof for cooperatively receiving threaded fasteners such as Allen bolts, as will be explained hereinafter.

Figure 5:
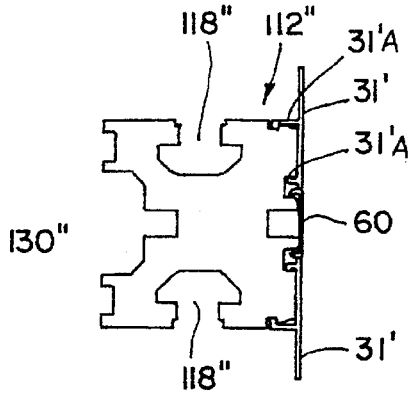
FIG. 5 is an end view of a modified post to serve as a heavy duty, horizontal post.
Figure 22:
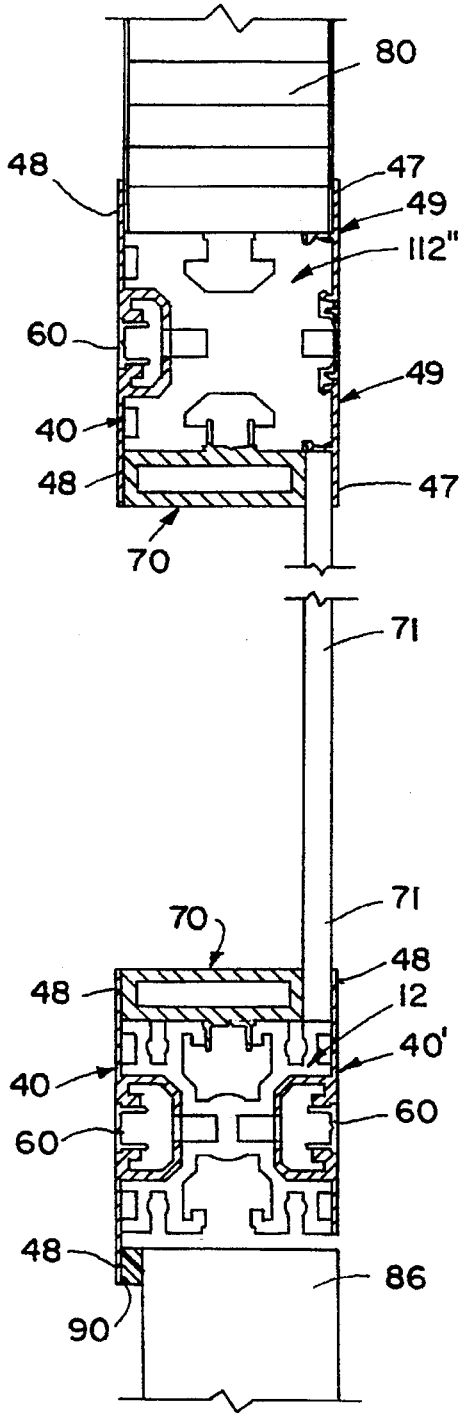
FIG. 22 is a cross sectional view of a representative header section, taken on plane 22—22 of FIG. 1.

In FIG. 5, a heavy duty, horizontal post 112" is depicted, such being useful, for example, above a header section, as depicted in FIG. 22. This post 112" is shown to include a pair of T-slots 118" in its lateral sides, and a U-shaped groove 130" in its front face, the rear face being shown generally covered by a pair of spaced, coplanar, elongated dress wings 31'. These wings have transversely projecting grip fingers 31'A which grip opposite edges of a knob of post 112". As an alternative to the attached wings 31', a post can have integral flanges as shown on the post of FIGS. 28 and 30.

Figure 6:
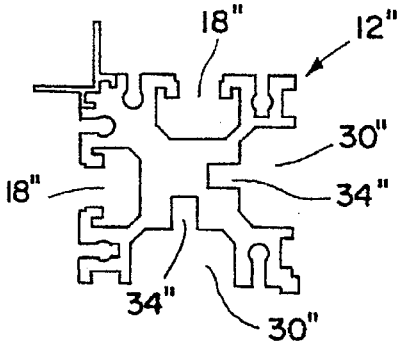
FIG. 6 is an end view of a post modified to serve as a corner post.

In FIG. 6 is depicted a corner post 12". It has its two elongated T-slots 18" in adjacent faces at 90° to each other, rather than in opposite faces, the other two adjacent faces having the female grooves 30", each with an inner channel 34" at its base.

Figure 7:
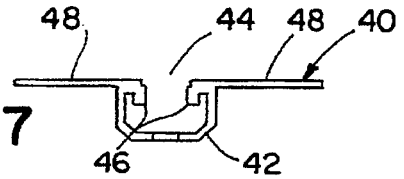
FIG. 7 is an end view of a full batten of the type most frequently used with this invention.
Figure 8:
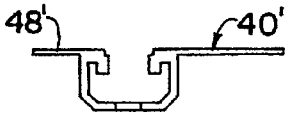
FIG. 8 is an end view of a modified batten showing one flange foreshortened.
Figure 9:
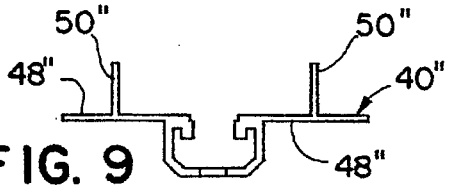
FIG. 9 is an end view of a modified full batten to serve in a T intersection as in FIG. 18 or FIG. 19.
Figure 18:
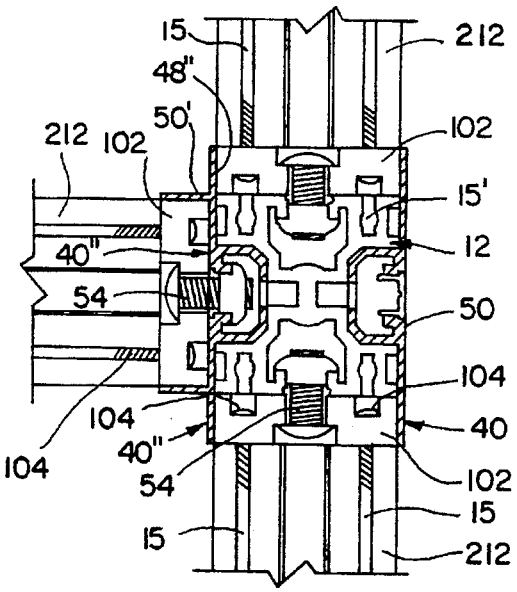
FIG. 18 is a cross sectional view showing a post subassembly in a T post arrangement, taken on plane 18—18 of FIG. 3.
Figure 19:
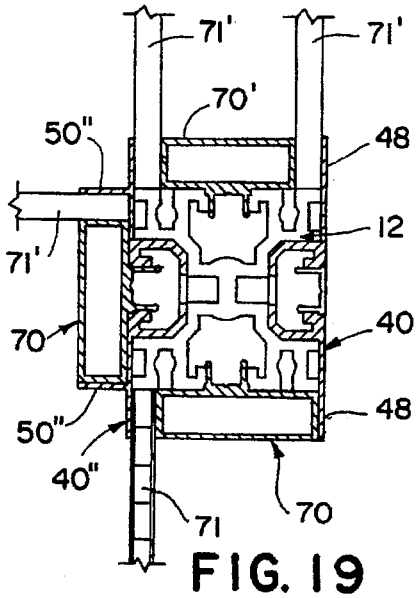
FIG. 19 is a cross sectional view of a post and panel arrangement in a T formation, and with glazing panels and other thin panels, taken on a plane above or below plane 18—18 in FIG. 3.

In FIGS. 7, 8 and 9 are shown three alternative elongated battens in accordance with this invention. These are of rigid structure, preferably being extruded of a metal such as aluminum. The full batten 40 in FIG. 7 is the most commonly used in an assembly. It includes a central male body 42 of a configuration and size matching that of the elongated female groove 30 in post 12. Batten 40 defines a central elongated T-slot 44 in body 42, and has a pair of elongated inner shoulders 46 astraddle the slot. These shoulders can have the alternative flat configuration as in the T-slot of the post in FIG. 25. Extending in opposite directions from body 42 is a pair of outer elongated flanges 48 of equal width. These coplanar flanges 48 extend laterally in opposite direction an amount such that the combined width of body 42 and flanges 48 is greater than the width of post 12 so that the flanges extend beyond the post. Hence, a pair of these flanges of two battens, when in parallel arrangement on opposite sides of a post, define an elongated receiving pocket along the length of the post, as will be explained more fully hereinafter. The modified batten 40' in FIG. 8 has the same central body as batten 40, but one of flanges 48' is shorter so as to terminate with its outer edge in alignment with the adjacent face of the post, rather than extending past it, as shown by and will be explained relative to FIG. 22, for example. The modified T-batten 40" in FIG. 9 has the same central body and the equal width flanges extending laterally from the body as the full batten in FIG. 7. However, it also has a pair of spaced, parallel flanges 50" perpendicular to the pair of lateral flanges 48", for assembly of posts or panels in a T-configuration, as shown in FIGS. 18 and 19, for example, and explained hereinafter. Hence, this batten may be called a T-batten.

Figure 10:
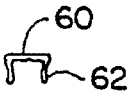
FIG. 10 is an end view of an enclosure cap.

FIG. 10 depicts an elongated snap-in enclosure cap 60 for insertion into an unused T-slot of any of the battens, or any unused portion along the length of such T-slots, e.g., between functional components suspended from the vertical or horizontal posts.

Figure 11:
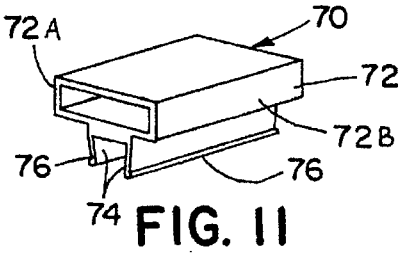
FIG. 11 is an isometric view of a spacer clip used as a glazing clip.
Figure 12:
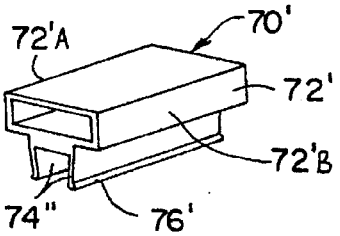
FIG. 12 is an isometric view of a modified spacer clip.

FIG. 11 discloses an elongated snap-in spacer clip used, for example, as a glazing clip 70, and shown to have a hollow, rectangular body 72 in cross section, and a pair of spaced, resilient clip-in legs 74 having enlarged beads 76 at the outer edges thereof. These cantilever legs 74 are slightly flexible toward each other, but biased to the outward position, and have an at-rest spacing slightly greater than the T-slot width, so that they may be flexed and inserted into a T-slot of a post or batten to be retained therein and serve as a spacer and to retain a pair of thin glazing panels as in FIG. 19, or other thin panels adjacent thereto. Spacer clip body 72 is shown in FIG. 11 to extend laterally further on one side 72A than on the other side 72B. Spacer clip 70 will cooperate with one thin panel in a manner illustrated in FIG. 21, for example. The spacer clip 70' in FIG. 12 differs from clip 70 only in having both lateral portions 72'A and 72'B of the body 72' extending laterally in equal amounts. Clip 70' has legs 74' and end beads 76' to be mounted in the same fashion as explained above. These spacer clips may vary somewhat in final shape, e.g., with the body having a different configuration and/or not fully enclosing the central space within it, and/or the legs having a slightly different configuration.

In FIGS. 14–23 are illustrated several possible arrangements and subassemblies which can be formed utilizing the invention, and forming portions of the illustrative arrangement in FIG. 1.

Figure 14:
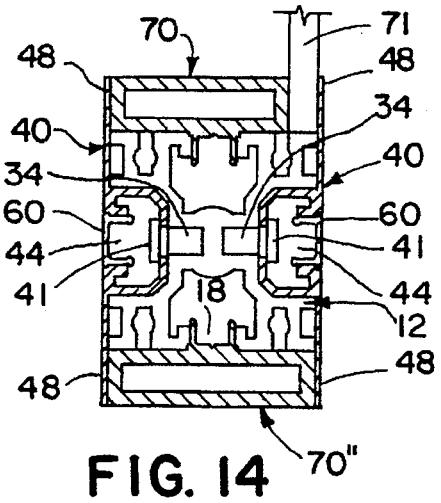
FIG. 14 is a cross sectional view of a potion of the wall system at the end of the wall, taken at plane 14—14 of FIG. 3.

In FIG. 14 is shown an end post subassembly which includes vertical post 12 having a pair of full battens 40 on opposite front and back faces. The body potions of the battens are mounted in the female grooves 30 of post 12 by Allen bolts 41 threaded into channels 34. The two flanges 48 of each of the two battens 40 extend beyond the adjacent faces of post 12 to define a pair of pockets on opposite sides of the post. One such pocket is filled by a spacer clip 70" which has a width equal to that of the post, thus nicely fitting within the inner walls of spaced parallel flanges 48 on one side of post 12, and has a depth equal to the flange extension beyond the post, to thus be flush with the flange edges. The pair of spring legs of clip 70" engage into T-slot 18 to secure it to the post. On the other side of post 12, in the pocket between the other two flanges 48 of battens 40, a thin panel 71, e.g., ¼ inch thick, in the form of a glazing panel 71 has an edge between parallel flanges 48, held against one of these flanges by spacer clip 70, one side edge of clip 70 engaging panel 71 and the other side edge engaging a flange 48.

The battens cover the juncture of glazing panel 71 with post 12 for optimum aesthetic appearance, while also retaining the panel in position. It will be noted that the battens, although serving this dress function, also accommodate the mounting of any desired component thereon because they provide the mounting T-slots 44 on the front and rear faces of the assembly for functional components. Hence, work surfaces such as shelves 202 (FIG. 1), computer modules, lights, desk surfaces, and/or a variety of other components can be mounted on the assembly utilizing these vertical and horizontal batten T-slots and cooperative T-bolts. Unused T-slots and/or those portions of said T-slots from which a functional component is not projecting can be covered by a simple snap-in-place dress enclosure cap 60 of desired length. Each enclosure cap has a pair of spaced, generally parallel, resilient legs 62 (FIGS. 10 and 14) flexible inwardly toward each other but biased outwardly so as to grip the T-slot at its inner shoulders for retention.

Figure 15:
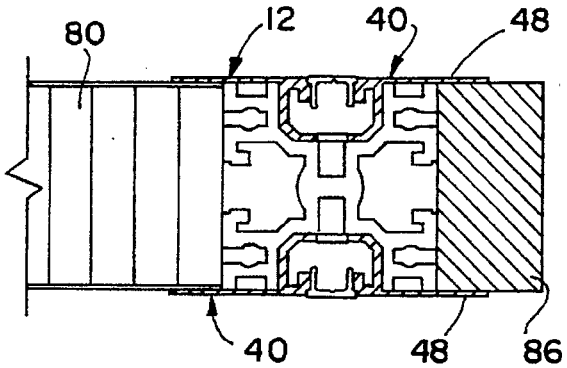
FIG. 15 is a cross sectional view of a bulkhead portion of the wall system.

In FIG. 15 is depicted a bulkhead detail arrangement according to this invention. More specifically, the post 12 there depicted includes a pair of full battens 40 on the opposite front and rear faces thereof such that the flanges 48 of the battens extend beyond the post on both lateral sides of the post, to form a pair of pockets between the pairs of parallel flanges. In one pocket is shown an edge of a wide panel 80, e.g., 1⅞ inches thick, filling the width of the pocket, while in the opposite pocket is a dress filler plug 86 of selected configuration and having a width filling the pocket between flanges 48. Plug 86 is preferably of a soft polymer to seal against a machine or device projecting into the adjacent opening.

Figure 16:
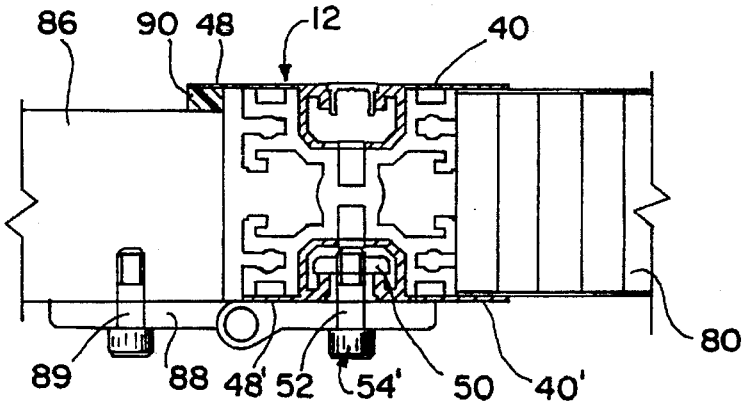
FIG. 16 is a cross sectional view of a door mounting portion of the wall system, taken at plane 16—16 of FIG. 3.
Figure 17:
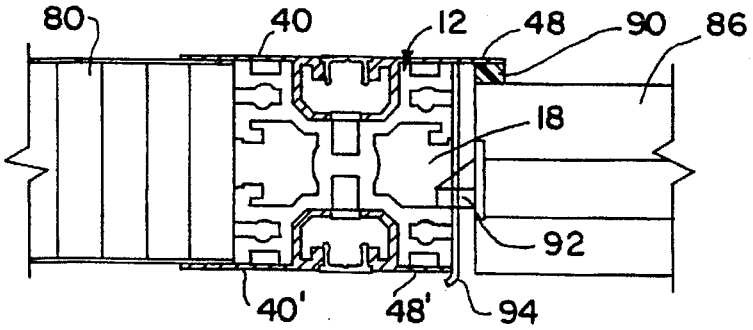
FIG. 17 is a cross sectional view of the opposite side of the door assembly in FIG. 16, showing the latch detail, taken on plane 17—17 of FIG. 3.

In FIGS. 16 and 17 is shown a hinge mounting detail and latch arrangement for supporting a conventional door directly on the post components according to the invention, and without using a special door jamb. More specifically, one vertical post 12 is shown to have one full batten 40 on the front side thereof and a modified batten 40' with a shortened flange 48' on the rear side, with the shortened flange 48' terminating at the lateral edge of post 12. A thick panel 80 has its edge in the pocket between the parallel flanges of battens 40 and 40' on one lateral side of post 12, while on the other lateral side of the post is the conventional door 86. This door is mounted on a plurality of hinges 88, one end of each hinge being secured to batten 40' by Allen-type T-bolt fasteners 54' having T-bolt nuts 50 and an Allen screw type of threaded bolt 52' and head. The other end of each hinge is mounted by conventional bolts 89 to door 86. Between the inside surface of door 86 and one of the flanges 48 of the full batten 40 is preferably a sealing gasket 90. In FIG. 17 is shown the opposite vertical edge of the door, namely that portion including the latch mechanism 92, and post 12 cooperative therewith. The latch bolt engages in one of the T-slots 18 of the second vertical post 12. Preferably this T-slot has a minor portion of the inner shoulder 20 removed on one side of the T-slot to best receive latch bolt 92. Again, a gasket 90 is between door 86 and flange 48 of full batten 40, the latter of which acts as a door stop on the front face of the post. On the opposite back face of post 12, a modified batten 40' with a shortened flange 48' is projecting beyond post 12 for optimum cooperation with latch bolt 92. On the opposite lateral side of post 12 is a thick panel 80 between the flanges of the full batten 40 and the modified batten 40'.

This novel construction enables a conventional door to be quickly and readily mounted simply by attaching the hinges with T-bolts to the batten T-slots. Moreover, the door can be mounted to open in either direction by selecting the post on which the hinges are attached, and can be attached with its hinges on either side of the opening. No special door frame and door jamb need be built, as is normally necessary with prior art systems. Alternatively, the door jamb in FIG. 28 can be employed.

Figure 24:
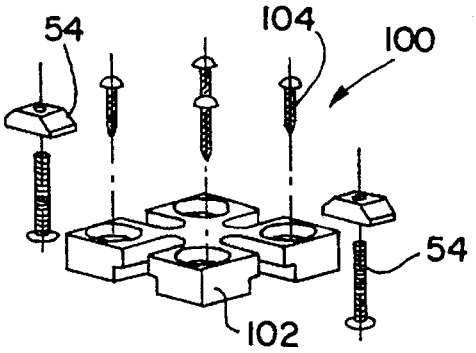
FIG. 24 is a perspective exploded view of an aligning and connector block with a pair of T-bolt fasteners and four threaded fasteners.

In FIG. 18 is shown the mounting of three horizontal posts 212 to a single vertical post 12 in a T-configuration by three connector block subassemblies 100 (see FIG. 24 for an individual connector block 102). More specifically, vertical post 12 has a full batten 40 on one front or back face, and a modified T-batten 40" on the opposite back or front face, each having full length flanges on both sides to define a pair of pockets on opposite lateral sides of the vertical post. Each of these connector block subassemblies 100 includes the connector block 102 itself, optionally a plurality of four threaded fasteners 104, and a pair of T-bolt connectors 54. Thus, referring again to FIG. 18, two of the connector blocks 102 are on opposite lateral sides of post 12 between the flanges of battens 40 and 40" attached thereto by T-bolt fasteners 54. Each of these connector blocks is mounted to the end of one of the horizontal posts 212 by threaded fasteners 104 which extend through block 102 and into axial cavities 15 of each elongated horizontal post 212. Connector block 102 is also secured to the vertical post 12 by T-bolt fasteners 54, the bolt head of which bears against a shoulder in block 102 and the nut 50 of which bears against the inner shoulders 20 of the T-slot. To make this a T arrangement, a third horizontal post 212, having its connector block 102 fastened thereto by fasteners 104, is fitted within the parallel, spaced flanges 50" which are normal to the lateral flanges 48" of the modified batten 40". These flanges 50" form a pocket therebetween for receipt of a connector block 102 which in turn is secured to the T-slot of batten 40" by T-bolt connectors 54. The thickness of connector block 102 is selected to equal the width of the flanges extending beyond the post.

In FIG. 19 is depicted panels in a T arrangement wherein thin panels are shown to extend from two opposite lateral sides and from a third front side perpendicular to the two opposite lateral sides. More specifically, a post 12 has on the respective front and rear faces thereof a full batten 40 and a modified T-batten 40" such that the flanges of both extend beyond both lateral sides of post 12 to form a pair of opposite lateral pockets, one pocket of which is shown to receive a single thin panel 71, e.g., ¼ inch thick, retained in position by a spacer clip 70 also within the pocket. The spacer clip 70 has one edge engaging a flange 48 and the other edge engaging panel 71. On the opposite lateral side of the post is shown a pair of spaced glazing panels 71', also approximately ¼ inch in thickness, having their edges within the pocket between the flanges of the battens and retained against these flanges by the intermediate spacer clip 70'. Spacer clips 70 and 70' are attached to the T-slots of post 12 by their snap-in resilient legs. Projecting from the third face, i.e., the front face, is shown another thin glazing panel 71' having its edge within the pocket formed between flanges 50" and retained in position by the spacer clip 70. As will be noted, the junctures of all of these panels with the post are covered by the battens, with the post also being completely covered. This provides optimum aesthetic appeal, as well as the advantage that the post need not be colored or painted to match any of the panels or battens.

Figure 20:
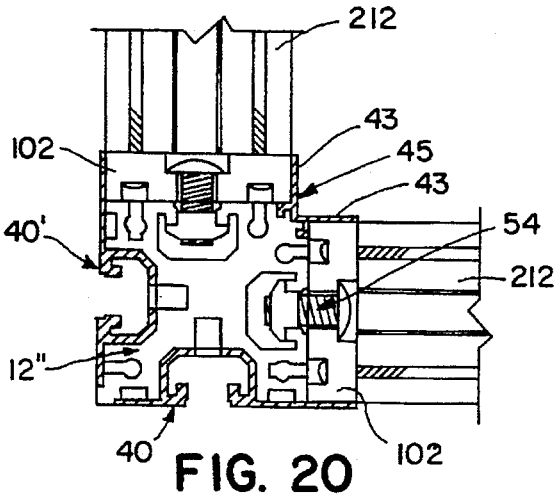
FIG. 20 is a cross sectional view of a typical corner post arrangement of this invention, taken on plane 20—20 of FIG. 3.

In FIG. 20 is depicted a corner post configuration possible with the invention and having horizontal posts extending therefrom, perpendicular to each other. More specifically, the corner post 12" is shown with two adjacent faces having grooves 30" for receiving the body portions of modified battens 40', each batten having one flange of full length extending beyond the edge of the post and a second flange shorter so as not to extend beyond the post. The other two adjacent faces of post 12" have T-slots 18" as explained earlier relative to FIG. 6. A pair of horizontal posts 212 are connected to these last two faces and the T-slots therein by connector blocks 102 and T-bolt fasteners 54 in the manner explained previously relative to FIG. 18. A corner batten 45, having flanges 43 at 90° to each other and a pair of gripping fingers on the back sides thereof, is retained by engagement of the fingers with special corner grooves in post 12". Flanges 43 cover and retain one edge of the adjacent connector blocks 102.

Figure 21:
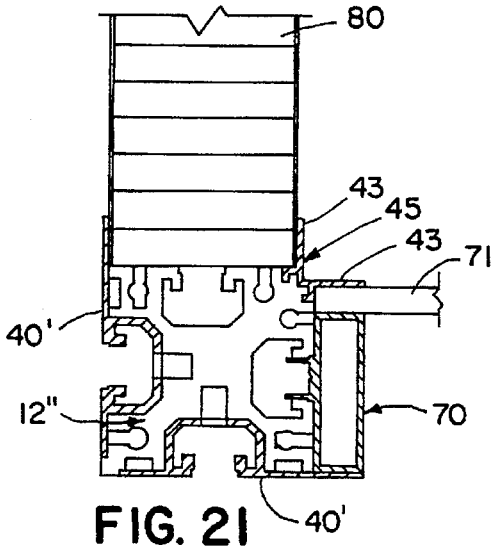
FIG. 21 is a cross sectional view of the corner post arrangement showing the panels, and taken on a plane above or below plane 20—20 of FIG. 3.

In FIG. 21 is depicted a corner post configuration having a pair of panels, one thick and one thin, projecting from adjacent faces of the post in perpendicular fashion to each other. More specifically, the corner post 12" has a pair of modified battens 40' on two adjacent faces thereof similar to that in FIG. 20, but its other two adjacent faces have panels extending therefrom and attached thereto. As depicted, a thin glazing panel 71 extends from one of the T-slot faces, being retained between the parallel flange of modified batten 40' and one flange 43 of corner batten 45, assisted by a spacer clip 70. Between the flange of the other modified batten 40' and the other flange 43 of corner batten 45 is another pocket receiving the edge of thick panel 80.

In FIG. 22 is illustrated a header arrangement formed in accordance with this invention. More specifically, a heavy duty header post 112" is arranged horizontally, with a regular post 12 also arranged horizontally and spaced therebelow, parallel thereto. Fitting into the horizontal channel 30' of post 12' is a full batten 40 having a T-slot and a pair of flanges extending upwardly and downwardly past the boundary faces of post 12'. These flanges 48 cooperate with flanges 47 of a pair of wing elements 49 which are clipped to the opposite sides of post 12' from batten 40. Vertical panel 80 extends upwardly from post 12' and has its lower edge between flanges 48 and 47. Extending downwardly from post 12' is a thin panel shown as a glazing panel 71, having its upper edge retained between flanges 47 and 48 by a spacer clip 70. The panel edge at the lower end of panel 71 is likewise contained between flanges 48 of batten 40 and modified batten 40'. These two battens are mounted to a horizontal post 12 on the front and rear faces thereof. Panel 71 is retained in position by a spacer clip 70. The unused T-slots of post 12' and post 12 are filled with a snap-in dress enclosure cap 60. The lower flange 48 of batten 40 extends down below post 12 and has a gasket 90 attached thereto to engage the upper edge of door 86 when closed. This door can comprise any simple generic door of one and three-quarter inch thickness, for example. No special door is required.

Figure 23:
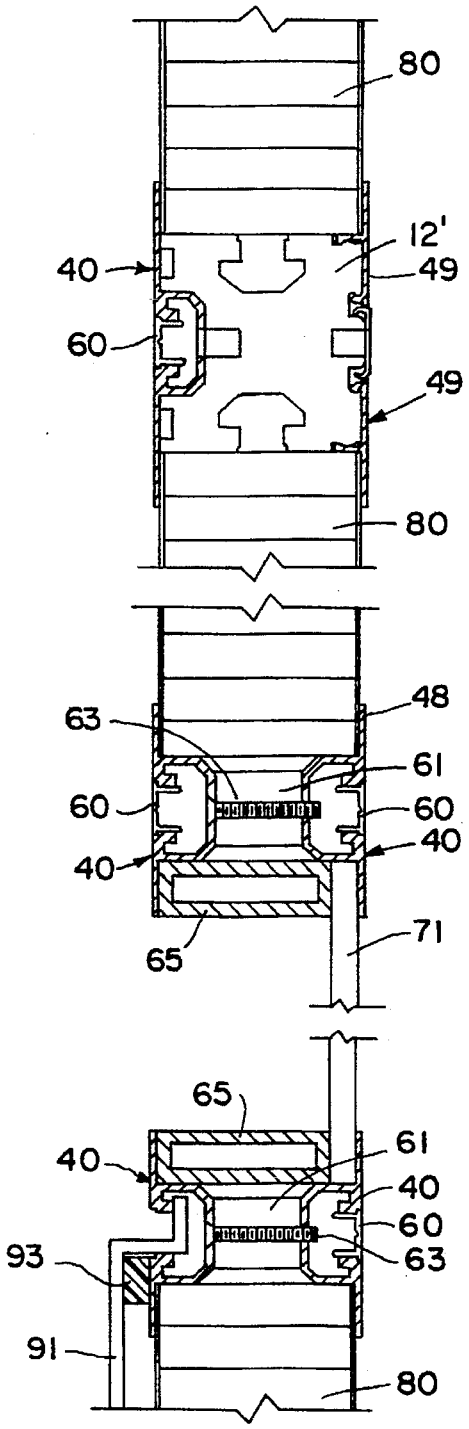
FIG. 23 is a cross sectional view of a window section according to this invention.

In FIG. 23 is depicted a vertical cross section illustrating an assembly including a window section and a hanging shelf arrangement. More specifically, there is depicted a modified, heavy duty, horizontal post 12' having a full batten 40 on the front side and a pair of wing elements 49 on the rear side, the flanges of these components forming a pocket on the upper end which receives the lower edge of a thick, i.e., full width, panel 80 and a pocket on the lower end receiving the upper edge of a full width panel 80. The bottom edge of this second full width panel is received in a pocket formed by the flanges 48 of a pair of full battens 40, parallel to and spaced from each other by an intermediate support 61 secured by fastener 63 therethrough. In the pocket beneath these two battens is a spacer 65 and the upper edge of glazing panel 71, the lower edge of the glazing panel being between a second pair of battens 40 and single spacer 65. The second pair of battens is also mounted together over a single spacer 61 with a threaded fastener 63. Below the second pair of battens 40 is another panel 80. A suspension bracket 91 has its offset upper end secured in the T-slot of one of the lower battens 40, and is shown with a gasket 93 between the bracket 91 and the batten 40, there being a shelf or the like (not shown) on the lower end of bracket 91. This illustrates how functional components can be suspended from the horizontal T-slots of the battens. Likewise, functional components can be suspended from the vertical T-slots of the vertical battens. The T-slots of this assembly in FIG. 23, or portions thereof which are not being functionally employed, can be covered with appropriate enclosure caps 60.

The posts and battens may be manufactured in standard 20 foot lengths and shipped as such. If the post and battens are to be used in an eight foot length, they can be simultaneously cut to that length all at one time. Thus, for example, if the posts 212 in FIG. 18 are to have battens, the flanges of the battens will nicely abut the flanges of battens 40 and 40" there shown, since blocks 102 have a thickness equal to the pocket depth. Therefore, the connector block 102 in FIG. 24, fastened to the end of a first post, enables that first post to be secured to other posts as illustrated in FIGS. 18 and 20, for example, without having to cut the ends of the battens shorter than the posts. Cuts made in the field during installations are therefore simple to make and the battens and posts will always have the same proper length.

All of the elongated post elements previously described, or structural elements described hereinafter, are preferably of extruded stock, normally aluminum, and are basically uniform over the length thereof.

Figure 25:
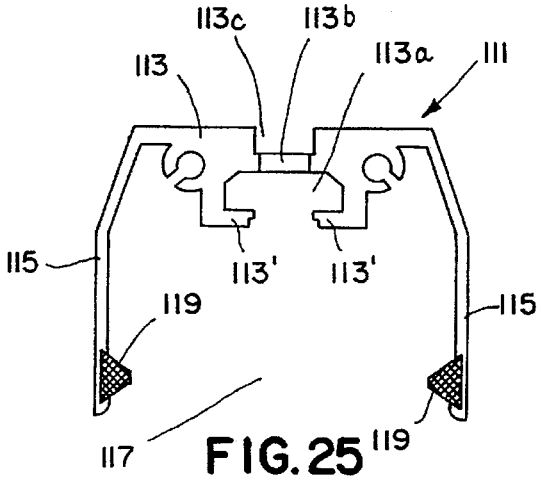
FIG. 25 is an end elevational view of a head track according to this invention.

In FIG. 25 is disclosed an end view of an elongated head track according to this invention. Its upper width is preferably such as to match a conventional, standard two-inch ceiling grid for mounting thereto. This head track 111 includes a generally flat elongated base 113 and a pair of elongated, downwardly depending, generally parallel, spaced wings 115 extending transversely to and integral with base 113, to define a space 117 therebetween. These wings each have elongated gaskets 119 attached to the inner faces thereof, as in dovetail slots, protruding toward but spaced from each other, to seal against opposite faces of a vertical post, a horizontal post, a panel or a batten therebetween. This sealing action inhibits air flow from one side of a wall to the other side. On the inner face of base 113 is a pair of flanges 113' which project toward each other to define a T-slot **113*a* for retention of a T-bolt (not shown), the head of which is in slot 113*a* and the stud portion of which extends through orifice 113*b* into a second slot 113*c* on the upper, outer face of base 113. This second slot is useful in retaining a T-nut threadably attached on the end of the T-bolt, so that the head track can be most conveniently secured to a ceiling grid or the like using the T-bolt and T-nut. A post can be hung from the head track 111 using T-nuts in a manner comparable to that previously described for the other embodiments. The space 117** can accommodate a wide panel, or one or two narrow panels, including glazing panels.

Figure 26:
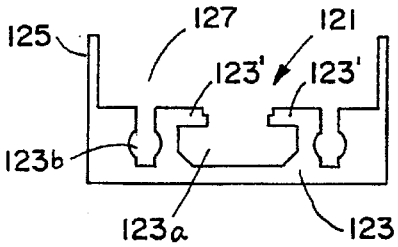
FIG. 26 is an end elevational view of a floor track.

In FIG. 26 is shown an end view of an elongated floor track 121 including a base 123 and a pair of upstanding side wings 125 spaced from and parallel to each other to define a central space 127 therebetween, to receive posts and/or panels. Base 123 has a pair of flanges 123' defining a T-slot **123*a* for receiving the head of a T-bolt connector, or a T-nut. Astraddle the elongated T-slot is a pair of elongated slots 123*b*** for receipt of threaded fasteners. This floor track can hide floor variations, can receive posts attached thereto using T-nuts, can serve as the start of a vertical wall, or can be used to form an opening closure. It can optionally extend between vertical posts, or extend continuously under the posts.

Figure 27:
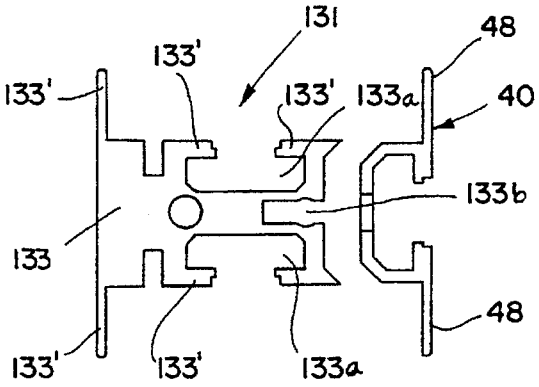
FIG. 27 is an end elevational view of a light duty post and a full batten.
Figure 33:
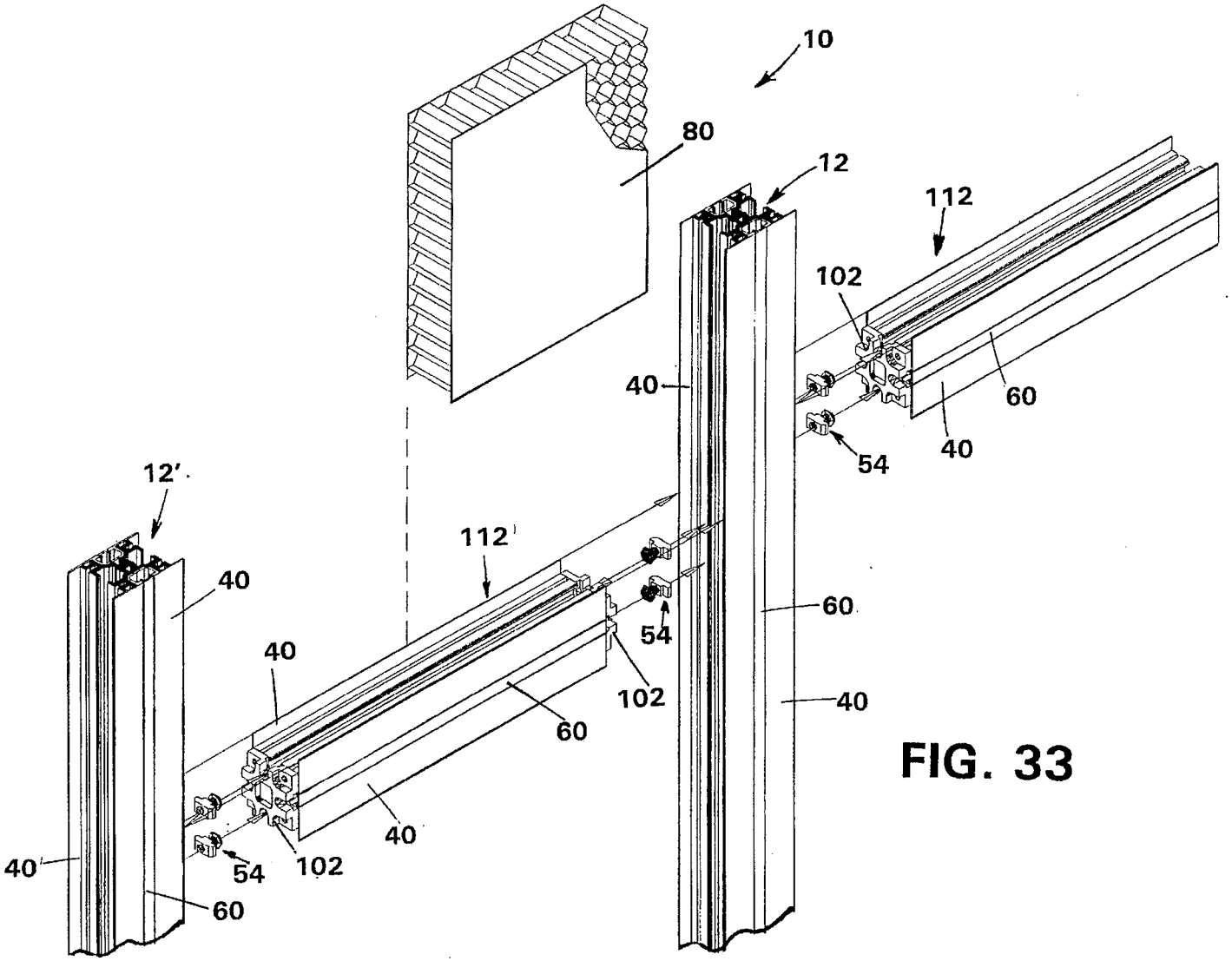
FIG. 33 is an exploded perspective view of a portion of the assembly in FIG. 1.

In FIG. 27 is disclosed an end view of an elongated light duty post construction 131 having a body 133, from the opposite sides of which a pair of flanges 133' extend in opposite directions. Body 133 also has a pair of T-slots **133*a* on opposite sides thereof, formed by flanges 133'. In the outer end of body 133 is a fastener receiving socket 133*b* to allow attachment of a full batten 40 by a T-bolt (not shown) such that the two flanges 48 of batten 40 are respectively parallel to the two flanges 133' of body 133. Thus, posts or panels can be received on one or both sides of the light duty post 131**, for framing air return grills, lightweight windows, or other panels of relatively light weight.

Figure 29:
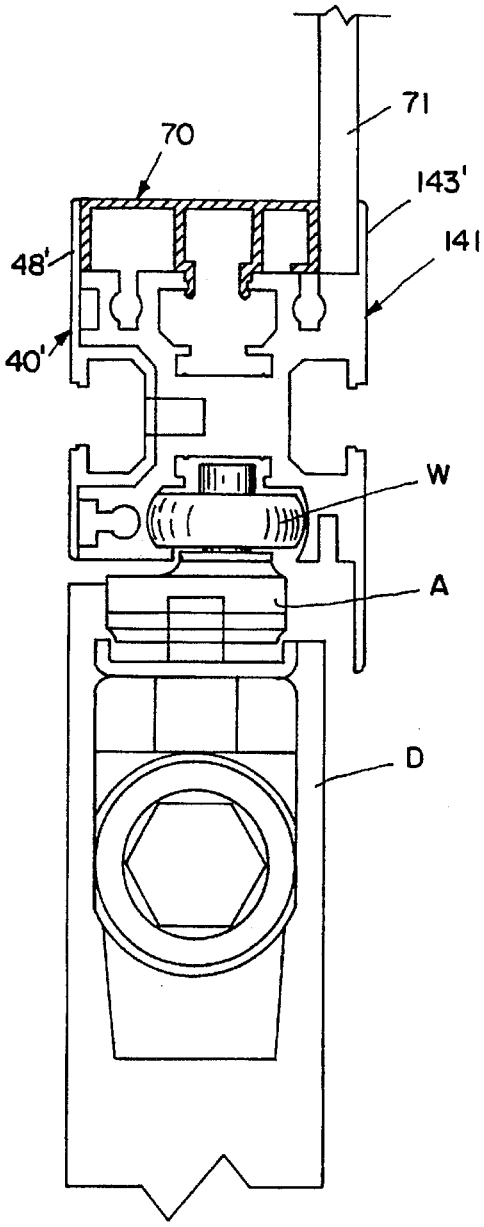
FIG. 29 is a sectional view of the top door jamb in FIG. 28, with portions of a conventional door and door closure arm.

FIG. 28 shows an end view of an elongated top door jamb 141 extrusion having a body 143 with functional features on all four sides thereof. Extending opposite each other from one side of body 143 is a pair of flanges 143' in the same plane. A T-slot **143*a* is positioned in the wall between these two flanges. On the opposite side of jamb 141 from T-slot 143*a* is a groove 143*b* comparable to groove 30 in the post of FIG. 4. This door jamb is intended to lie in horizontal orientation at the upper end of the door. In the bottom of body 143 is a track 143*c* to receive a door closure arm of conventional type as depicted in FIG. 29 and described more fully hereinafter. This track 143*c* has opposite, concavely curved side walls to receive, interfit with, and accommodate the roller wheel W of a conventional self closure arm A of door D in FIG. 29. On the side of body 143 opposite track 143*c* is another T-slot 143*d* for attachment to a post or panel. Body 143 also includes a gasket groove 143*e* adjacent track 143*c*, and optionally includes attachment slots 143*f***.

In FIG. 29 is illustrated the combination of this top door jamb 141 with door D which includes the closure arm A having wheel W thereon and in track **143*c*. A half batten 40' is shown mounted to one outer face of door jamb 141 and a narrow panel 71 retained in position against flange 143' by glazing clip 70. Panel 71 and glazing clip 70 are retained between the two parallel flanges 143' and 48'**.

In FIG. 30 is illustrated an elongated side door jamb 151 which is basically like the top door jamb in FIG. 28 except, instead of track **143*c*, that side of body 153 is closed by an integral panel 153*c*. The assembly of the side door jamb 151 with other components is depicted in FIGS. 31 and 32**.

In FIG. 31 the elongated side door jamb is shown combined with a partial batten 48' such that a panel 71 can be combined with spacer clip 70' on one side and is cooperative with door D on the opposite side adjacent panel 153*c*. A gasket 155 has its flange mounted in slot 153*e* so that the tubular gasket is squeezed between door D and flange 153' when the door is closed, to serve as a door stop.

FIG. 32 shows a different sectional view of the assembly in FIG. 1, at the door latch, such that latch 171 extending from latch assembly 171' of door D extends into a latch-receiving slot 153*f* routed into panel 153*c* at the area of latch 171.

Attachment of connector blocks 102 requires no special craftsmanship since fasteners 104 simply screw into the slots 15 which extend the length of each post and thus are always found at the ends of each post.

As will be apparent from the illustrative assemblies shown, a wide variety of arrangements can be readily made using the novel assembly. Each post in the assembly, whether vertical or horizontal, is hidden from view so that the post need not be colored or painted in order to match the panels. The battens can be colored in complementary or matching colors. If it is decided to change the coloring of the panels, the panels and battens can be readily removed while leaving the basic supporting post construction in place, coloring the panels or replacing them as desired with differently colored battens, thereby creating a new environment arrangement. If it is desired to mount doors or windows, or exchange doors or windows or panels or other components, this can be readily accomplished simply by removing the appropriate fasteners for the battens, removing the battens and then the panels or other components, inserting the substitute panels or other elements in the arrangement desired, and replacing the battens and their fasteners. If individual vertical or horizontal posts need be removed, inserted or shifted, each is accommodated by removing and/or securing the fasteners. The structure readily accommodates thin panels, thick panels, and a wide variety of combinations. Panels can be inserted, removed and/or replaced by removing the battens on only one side. It is not necessary to remove battens from both sides.

It will be apparent to those having skill in this art that the number of variations achievable with the novel system is practically without limit. Furthermore, minor changes can be made in components of the preferred apparatus disclosed as exemplary of the invention, without departing from the concept hereof. Therefore, it is not intended that the invention be limited by the specific description of the illustrated embodiments, but only by the scope of the appended claims and the reasonably equivalent structures to those defined therein.

The embodiments of the invention in which an exclusive property or privilege is claimed are defined as follows:

1. A post and batten assembly for a wall panel system, comprising:

an elongated post having a plurality of sides, at least one of said sides having an elongated groove;

an elongated batten having a central body positioned in said elongated groove and attached to said post, said batten having a pair of flanges extending opposite each other;

said batten central body having an outer face, and defining an elongated, component-mounting cavity open at said outer face, and said cavity having a pair of elongated, inwardly facing inner shoulders astraddle said elongated cavity, said cavity and said inner shoulders being arranged and oriented to define a T-slot in said batten to receive and engage a T-bolt nut of a T-bolt fastener;

T-bolt nuts in said cavity of said batten central body, and T-bolts threadably connected to said T-bolt nuts for mounting components on said batten.

2. The assembly in claim 1 including fasteners connecting said elongated batten to said post.

3. The assembly in claim 1 wherein said post has a pair of outer shoulders astraddle said groove, and said batten flanges engage said outer shoulders of said post.

4. The assembly in claim 1 wherein at least one of said flanges extends beyond said post.

5. The assembly in claim 3 wherein two opposite sides of said post each have said elongated groove and a pair of said outer shoulders astraddle each said groove, and including a pair of said elongated battens, each having a central body with an outer face, and a pair of flanges extending opposite each other at said outer face, and said flanges of said pair of battens extending beyond said post parallel to each other on at least one side of said post, to define a panel-receiving pocket therebetween.

6. The assembly in claim 5 wherein said flanges of said pair of battens extend beyond said post on two opposite sides of said post, parallel to each other, to define two panel-receiving pockets.

7. The assembly in claim 1 wherein said post has two sides opposite each other, adjacent to and orthogonal to said at least one side, at least one of said two opposite sides having a T-slot therein.

8. The assembly in claim 1 wherein said post has four sides, at least one of said sides having said elongated groove, and two of said sides having said T-slots.

9. The assembly in claim 7 wherein said post has four sides, two of said sides having said elongated grooves, and the other two of said four sides having said T-slots.

10. The assembly in claim 9 wherein said post is a first post, including a connector block attached to said post on at least one of said other two sides, and a second post oriented orthogonally to said first post and having an end attached to said connector block so as to be indirectly connected to said first post.

11. The assembly in claim 10 including fasteners attaching said end of said second post to said connector block.

12. The assembly in claim 10 wherein said connector block is within one of said receiving pockets between a pair of said flanges.

13. The assembly in claim 5 including a panel in said panel-receiving pocket.

14. The assembly in claim 13 wherein said panel engages both said flanges of said panel-receiving pocket.

15. The assembly in claim 13 wherein said panel is a thin panel which engages only one flange of said panel-receiving pocket, and said assembly includes a spacer clip attached to said post, and engaging said panel and the second flange of said pocket.

16. The assembly in claim 5 including a pair of thin panels in said panel-receiving pocket, spaced from and parallel to each other, each panel engaging a respective one of said flanges, and said assembly includes a spacer clip between said panels and engaging both said panels.

17. The assembly in claim 4 wherein said post also has a pair of oppositely extending flanges parallel to said batten flanges, said pairs of flanges defining two receiving pockets on opposite sides of said post.

18. The assembly in claim 1 wherein said post has a door-closer-arm-receiving track.

19. The assembly in claim 1 wherein said post has at least one laterally extending flange forming a door stop.

20. The post and batten assembly in claim 4 wherein said post has an integral flange parallel to said batten flange to create a pocket therebetween.

21. The post and batten assembly in claim 1 including an enclosure cap attached over and covering at least part of said batten T-slot.

22. A post subassembly for a panel wall system, comprising:

a first elongated post having four sides and two ends;

at least one of said sides having a groove for receiving and mounting a batten, and at least one of said sides having an elongated T-slot for receiving a T-bolt fastener;

a second elongated post having four sides and two ends, at least one of said second post sides having a groove to receive a batten and having a T-slot, said second post being positioned normal to said first post, and T-bolts attaching said connector block, and thus said second post, to said first post;

said posts also having additional slots which extend through said ends, said slots being configurated to receive threaded fasteners;

a first connector block on at least one of said second post ends, and threaded fasteners extending through said connector block and into said post slots;

said connector block also having T-slots for attachment with T-bolts to a T-slot of a second post; and a batten mounted in said groove of said first post, said batten having a flange which extends over and thereby covers said connector block.

23. The post subassembly in claim 22 including a third post parallel to and spaced from said first post, and normal to said second post; said third post having at least one groove to receive a batten; a second connector block secured to the second end of said second post and having T-slots; T-bolts securing said second connector block to said third post, and thus said second post to said third post; and a batten in said groove of said third post, said third post batten having a flange which extends over and thereby covers said second connector block.

24. The post subassembly in claim 23 including two battens attached to each of said first, second and third posts and having flanges extending laterally beyond said respective first, second and third posts; and at least one panel having its edges retained adjacent said posts by and between said flanges.

* * * * *

UNITED STATES PATENT AND TRADEMARK OFFICE

CERTIFICATE OF CORRECTION

PATENT NO. : 5,634,300
DATED : June 3, 1997
INVENTOR(S) : Fritz Huebner et al.

It is certified that error appears in the above-identified patent and that said Letters Patent is hereby corrected as shown below:

Column 6, line 1;

"potions" should be --portions--.

Signed and Sealed this

Twenty-seventh Day of January, 1998

*Attest:*

*Attesting Officer*

Bruce Lehman

BRUCE LEHMAN

*Commissioner of Patents and Trademarks*